United States Patent [19]

Bird

[11] Patent Number: 4,923,082

[45] Date of Patent: May 8, 1990

[54] CARRIER FOR BEVERAGE CARTONS

[76] Inventor: Stanford W. Bird, 745 Three Fountain Cir., Salt Lake City, Utah 84107

[21] Appl. No.: 340,843

[22] Filed: Apr. 20, 1989

[51] Int. Cl.[5] ..... B65D 5/46; B65D 25/28

[52] U.S. Cl. ..... 220/85 H; 220/94 R; 229/117.19; 294/152

[58] Field of Search ..... 206/428; 220/85 H, 85 R, 220/94 B, 94 R, 96; 294/145, 149, 152–157; 229/52 A, 52 AC, 52 AL, 117.13, 117.14, 117.19

[56] References Cited

U.S. PATENT DOCUMENTS

| | | | |
|---|---|---|---|
| 466,670 | 1/1892 | Fler | 294/152 |
| 935,364 | 9/1909 | Gillespie | 294/152 |
| 2,272,314 | 2/1942 | Williams | 294/152 |
| 2,289,964 | 7/1942 | Hanford | 294/152 |
| 2,961,121 | 11/1960 | Bergey | 220/85 H |
| 3,220,626 | 11/1965 | Tupper | 294/152 |
| 3,923,222 | 12/1975 | Groves | 294/157 |
| 4,478,450 | 10/1984 | Picozza | 220/94 R |

FOREIGN PATENT DOCUMENTS

| | | | |
|---|---|---|---|
| 1349429 | 12/1963 | France | 294/149 |

*Primary Examiner*—Jimmy G. Foster
*Attorney, Agent, or Firm*—M. Reid Russell

[57] ABSTRACT

A carrier for carton-type, downwardly tapered beverage containers and the like having a body made of flat, thin, durable and bendable material such as polyethylene plastic and having a central carton engaging portion made of interconnected straps, with a gusset at each strap connection and a pair of handles formed from straps at oppositely positioned relative to said central portion and with the support straps of each handle coupled during use by a tap foldably connected to one said support straps.

2 Claims, 1 Drawing Sheet

CARRIER FOR BEVERAGE CARTONS

BRIEF DESCRIPTION OF THE INVENTION

1. Field of the Invention

This invention relates to low cost, easily used carriers for beverage containers.

2. Prior Art

A great many containers have been proposed for the storage, carrying and dispensing of beverages. Recently a two quart cardboard carton-type container has been developed that is used by consumers to receive dispensed beverages, i.e., soft drinks, fruit juices, punch, etc., and to hold the liquid content as it is transported and stored, or as the user drinks the contents through a straw. The container is generally sealed by folding the edges of an open top together and then holding the top together with a flexible clamp. It has been found, however, that with the container filled a user will often either pull on the folded top during lifting of the container or will squeeze the body of the container. In either case, the flexible clamp is frequently snapped off, the top opens and the contents spill. The weight of these filled two-quart containers is usually enough that they cannot be lifted without gripping them firmly, and a firm grip tends to cause spillage of the contents.

In my co-pending U.S. application for patent Ser. No. 338,887, and Ser. No. 338,885, respectively, I have disclosed a carrier for use with smaller type bottle containers having discharge necks and flat-type, frictionally secured caps and a carrier for use with larger plastic bottles having a flanged neck and telescoping threaded cap. The carriers disclosed are formed from a thin, flat, durable and bendable material, such as polyurethane plastic and they have proven very effective for their intended uses. Both of the disclosed carriers, however, grip the container in the region of the bottle neck and they are not suitable for use with the large cardboard containers for liquids described above.

OBJECTS OF THE INVENTION

Principal objects of the present invention are to provide a low cost, easily used carrier for downwardly tapered liquid containing cartons and other take-out type food containers that will allow for easy transportation of the filled carton container without spillage of the contents thereof.

Other objects are to provide a carrier that is comfortable to use and that securely and safely holds the filled container during transportation.

FEATURES OF THE INVENTION

Principal features of the invention include a body, made of a flat, thin, durable and bendable material, such as polyethylene plastic, and having a central carton engaging portion and a pair of oppositely arranged handle portions, one of which has a folded tab. The central portion is made of interconnected straps and triangular gussets at the strap junctions that will lie flat against the container and the handle portions are also formed of straps, to reduce the overall cost of the carrier.

Other objects and features of the invention will become apparent from the following detailed description and drawing disclosing what are presently contemplated as being the best modes of the invention.

THE DRAWING

In the drawing:

FIG. 1 is a plan view of the carrier of the invention;

FIG. 2, a side elevation view; and

FIG. 3, a perspective view of the carrier shown supporting a carton-type drink container.

DETAILED DESCRIPTION

Figure 1:
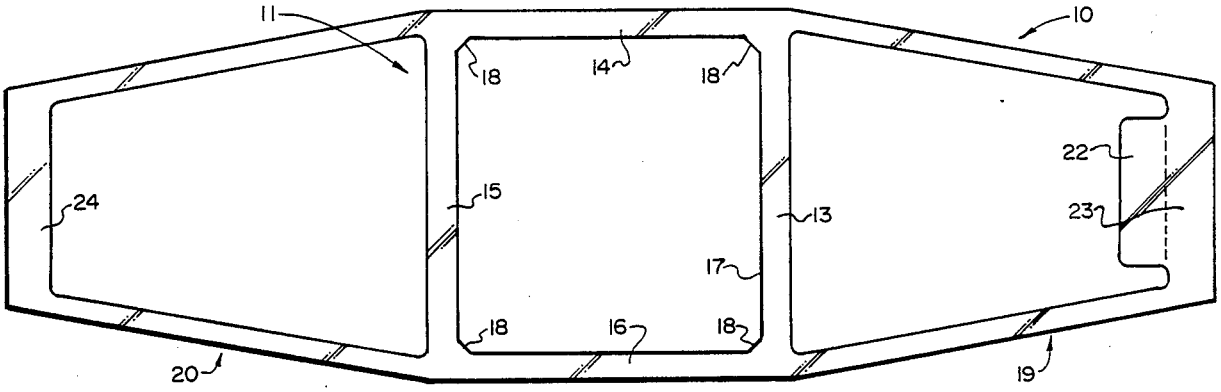
Figure 2:
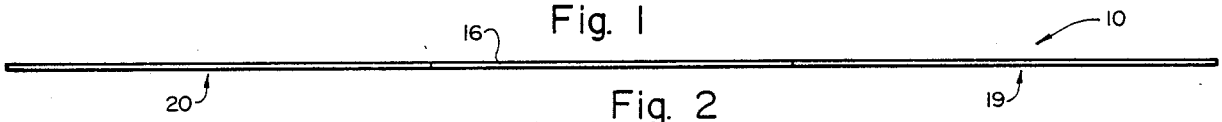
Figure 3:
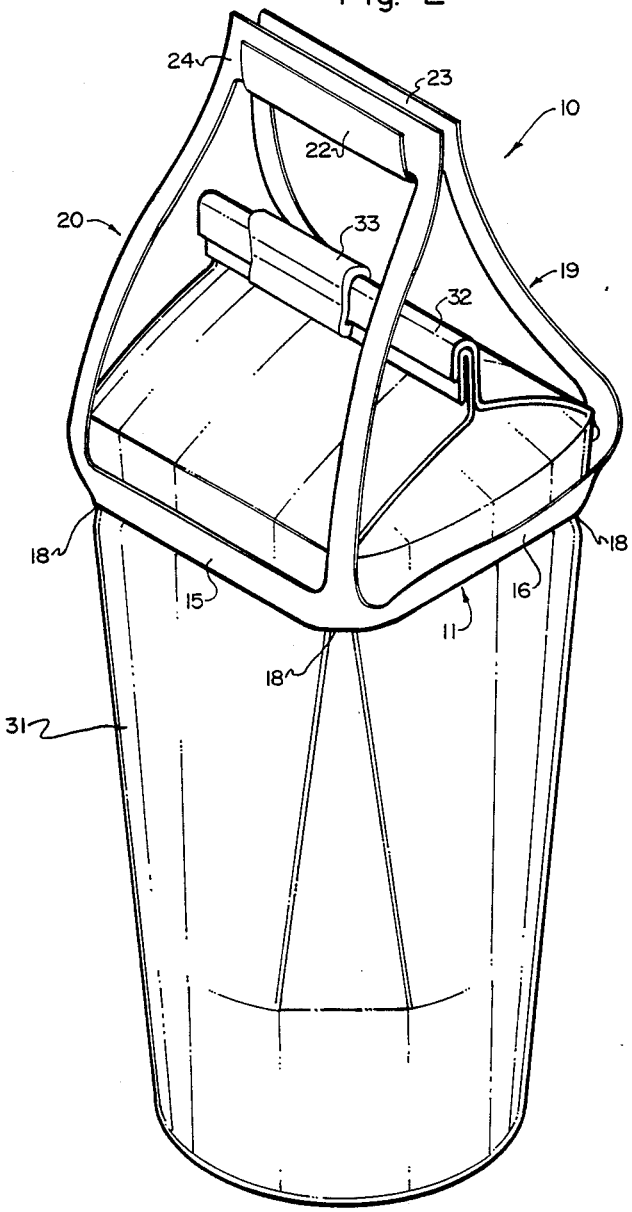

Referring now to the drawings:

In the illustrated preferred embodiment of the invention the carrier, shown generally at 10, includes a central carton engaging portion 11 made up of straps 13, 14, 15 and 16 that surround and define a substantially square opening 17. The intersection of each pair of straps is provided with a triangular gusset 18.

A pair of handles 19 and 20 extend from opposite sides of the portion 11 and each include straps 21 and 22 that extend from opposite corners and converge slightly to a cross-member support strap 23 and 24, respectively. The support strap 24 has a tab 25 extending therefrom, inwardly between its straps 21 and 22, and a fold line 26 formed between the support strap 23 and the tab 25.

In typical use, the carrier 10 is placed flat on a surface, the bottom 30 of a downwardly tapered, carton-type container 31 is placed in the opening 17 and the container is filled with a liquid, such as a soft drink beverage. The top 32 of the container is closed and clamped with a clamp 33 and the handles 19 and 20 are grasped and lifted. The handles are brought together above the container and cross-member 24 is placed against support strap 23. The tab 25 is folded on line 26 beneath the support strap 24 to provide a rounded, smooth, comfortable feeling handle for the carrier that will insure equal pulling on both handles.

Continued lifting on the carrier turns straps 13–16 flat against the container outer wall and the corners 18 are turned to be flat against corresponding corner breaks on the container. The carrier snugly engages the outer wall of the tapered container as the container is lifted with the carrier being held against slippage on the container by the taper of the container.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A carrier for a carton-type, tapered container comprising a body made of flat, thin, durable and bendable plastic material and having a generally rectangular central body portion made of interconnected straps and with a triangular gusset at each strap connection; and a pair of handles formed from straps at opposite ends of said central portion and each handle having a support strap to be grasped by a user.

2. A carrier as in claim 1, further including a tab foldably attached to one of said support straps and arranged to receive the other of said support straps in the said fold line.

* * * * *